United States Patent [19]

Cooper

[11] 3,940,126

[45] Feb. 24, 1976

[54] SHEET HANDLING MECHANISM

[75] Inventor: John William Douglas Cooper, Hitchin, England

[73] Assignee: Xerox Corporation, Stamford, Conn.

[22] Filed: June 11, 1974

[21] Appl. No.: 478,209

[30] Foreign Application Priority Data

Dec. 21, 1973 United Kingdom ..... 59537/73

[52] U.S. Cl. ..... 271/174; 271/DIG. 2; 355/3 DD

[51] Int. Cl.[2] ..... B65H 29/56

[58] Field of Search ..... 271/174, 80, DIG. 2, 193; 355/3

[56] References Cited

UNITED STATES PATENTS

| | | | |
|---|---|---|---|
| 3,508,824 | 4/1970 | Leinbach et al. | 271/174 X |
| 3,685,898 | 8/1972 | Gonzalez | 271/DIG. 2 |
| 3,690,646 | 9/1972 | Kolibas | 271/193 X |
| 3,834,690 | 9/1974 | Knechtel | 271/DIG. 2 |

*Primary Examiner*—Evon C. Blunk
*Assistant Examiner*—Bruce H. Stoner, Jr.

[57] ABSTRACT

A reproduction machine has a photoconductive surface and a stripping device for separating the leading edge of a transfer sheet from the surface. Located adjacent to the stripping device is a guide which is maintained at a reference voltage such that an electrostatic attraction is set up between the guide and the transfer sheet so as to draw the latter toward the guide. A support member generally uniformly separated from the guide serves to support the transfer sheet in the event the electrostatic attraction is insufficient to draw the transfer sheet to the guide. Either the guide or the support member may be at least partially covered by a layer of insulating material.

1 Claim, 4 Drawing Figures

SHEET HANDLING MECHANISM

BACKGROUND OF THE INVENTION

This invention relates to sheet handling and processing mechanisms.

Sheet handling and processing mechanisms are employed in conventional automatic electrostatographic imaging systems. For instance, a single sheet is fed onto an electrophotographic drum where the developed image is transferred from the drum to the sheet. After the transfer step is completed, the sheet is stripped from the drum.

There are several known methods by which a sheet is separated from a drum; for example, that shown in U.S. Pat. No. 3,062,536 to Rutkus. This mechanism employs a manifold having a multiple outlet conduits or nozzles directed against the surface of the electrostatographic drum so that jets of compressed aeriform fluid from the nozzles are directed against the leading edge of the sheet being transferred to blow the edge of the sheet off the drum. In this system the remainder of the sheet being transferred is then peeled from the drum due to its own weight. The manifold is supplied with compressed aeriform by means of a pulsator or similar source of compressed aeriform fluid.

Another method utilizes mechanical arms which are physically inserted between the sheet and the conveyor surface. This type of apparatus is normally programmed so that the arm is placed against the drum surface as the sheet approaches the vicinity of the stripping area. When the sheet meets the arm, it is physically separated from the conveyor surface by the arm being inserted between the two. To assure that the sheet is always separated and diverted from the drum, the tip of the arm usually travels in recesses on the drum surface so that there is no possible way the sheet can move past the arm. An improvement in this type of system is described in U.S. Pat. No. 3,450,402 to Weiler. This apparatus consists of an arm carrying a multitude of wedge shaped fingers located adjacent to and spaced across the path of travel of the sheet being carried by the conveyor surface. The fingers are biased against the conveyor surface when the leading edge of the sheet reaches the vicinity of the fingers to cause separation of the sheet from the drum. After the leading edge of the sheet is separated, the arm rotates moving the fingers and the edge of the sheet away from the conveyor surface.

Whatever form of sheet stripping mechanism is provided, it is desired that the sheet or copy carrying medium which could be of continuous web form, continues to strip from the conveyor or drum surface. In many instances the copy carrying medium will continue to strip under the action of its own weight after its leading edge has been separated by one form of stripping device or another. However, in some instances we have found that the copy carrying medium does not continue to strip satisfactorily along its length under the action of gravity alone. In other instances, the copying apparatus is so positioned that the action of gravity is not in a direction that assists the stripping action and may even be acting counter to the desired direction for such stripping action.

SUMMARY OF THE INVENTION

It is an object of this invention to provide a stripping aid for an electrostatic copying machine or for any other machine in which a laminar medium retains a net electrostatic charge after being processed.

According to the invention, there is provided a stripping aid for an electrostatographic copying machine comprising a guide arranged to be maintained at a reference voltage and mounted adjacent a stripping device, such that in use an electrostatic attraction is set up between the guide and the copy carrying medium to draw said medium towards said guide.

DETAILED DESCRIPTION OF THE INVENTION

Figure 1:
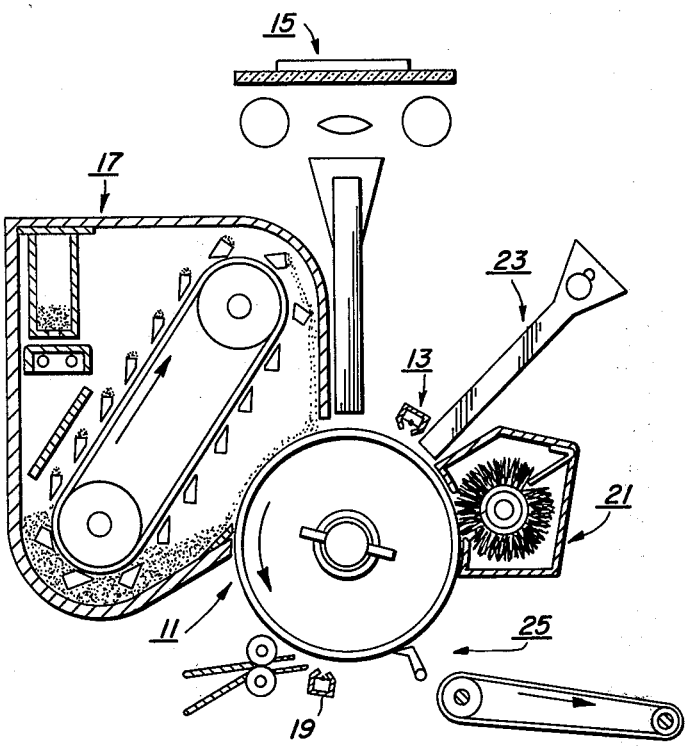
FIG. 1 shows schematically for illustrative pusposes an electrostatographic copying machine.

Referring to the drawings, FIG. 1 is generally illustrative of a conventional automatic electrophotographic reproducing apparatus. The principal element is number 11 bearing a photoconductive insulating layer or like receiving surface formed in the shape of a drum which is mounted for rotation. The drum is first passed through a charging station 13 at which a uniform electrostatic charge is deposited on the photoconductive layer. The drum is then passed through exposure station 15 at which a light or radiation pattern is projected onto the drum surface to dissipate the charge in the exposed areas thereof and thereby form an electrostatic latent image of the copy to be reproduced. Next, the drum is passed through the developing station 17 at which a developing material including toner particles having an electrostatic charge opposite to that of the electrostatic latent image is cascaded over the drum surface whereby a portion of the toner particles adhere to the electrostatic image to form a powdered image in the configuration of the copy to be reproduced. After developing the electrostatic latent image, the drum passes through transfer station 19 at which the powder image is electrostatically transferred from the drum surface to a transfer material or sheet. Thereafter the drum surface is brushed at station 21 to remove any residual toner particles remaining on it after image transfer, and the drum surface is exposed as station 23 to a relatively bright light source to effect substantially complete discharge of any residual electrostatic charge remaining on it in preparation for the next cycle.

After the development step and prior to the transfer step, the sheet to which the toner image is to be transferred is fed onto the photoconductive element or drum 11, the periphery of the drum becoming its conveying surface. The sheet may be any conventional size provided that it is made of semi-flexible material such as paper, plastic, film, etc.

The stripping apparatus designated as 25 is positioned adjacent the drum 11 subsequent the image transfer station 19, but prior to the cleaning station 21. It is necessary to remove the sheet from the drum 11 at this point in order to further process the sheet at a location remote from the drum. For instance, once a sheet is removed from the vacinity of the drum 11 the toner image can be fused to the sheet or otherwise made permanent without any deleterious side effect to the photoconductive surface of the drum 11. It is believed that the foregoing description is sufficient for purpose of this application to show the general operation of a known electrostatographic reproducing apparatus using a sheet stripping apparatus. For present purposes, it is sufficient to explain that the stripping device comprises one or more bristled interposers which are inserted between the sheet and the drum 11. The interposers are swung out of the path of the sheet as soon as the leading edge of the sheet is separated from the drum.

Figure 2:
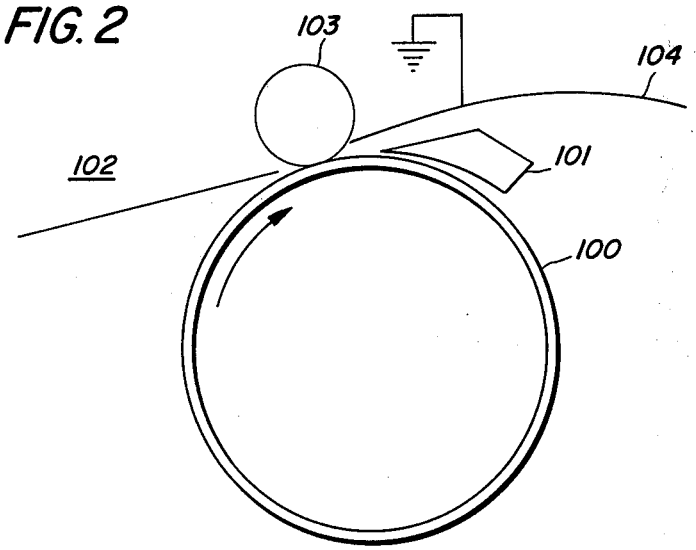
FIG. 2 shows diagrammatically the stripping aid.
Figure 4:
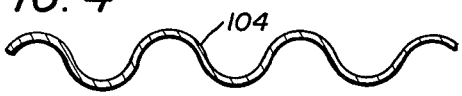
FIG. 4 shows how a modification of the present invention would appear if taken through line 4—4 of FIG. 3.

Referring to FIG. 2, a photoreceptor 100 is provided with a sharp-nosed stripping device 101. A paper transport system 102 is mounted above the photoreceptor 100 to supply sheets to pass between the surface of the photoreceptor 100 and a transfer roll 103. A metallic plate 104, which is electrically earthed, is mounted above the stripping device 101.

In use, the sheets pass under the transfer roll 103 to receive an image from the surface of the photoreceptor 100. The leading edge of each sheet is separated from the surface of the photoreceptor 100 by the stripping device 101 so that the leading edge moves towards the plate 104. Due to contact with the surface of the photoreceptor, each sheet attains at nett electrostatic charge. Thus, an electrostatic field is set up between the surface of the sheet and the surface of the plate 104 which tends to attract the sheet towards the plate 104. In practice, this attraction acts to strip the sheet, except for the leading edge, from the surface of the photoreceptor 100 so that the surface of the sheet does not contact the stripping device 101. This feature is particularly advantageous and especially as illustrated acting against gravitational forces, where the image transferred to the sheet is not firmly established and/or would be spoiled by rubbing contact. In the arrangement illustrated, it is noted that the image carrying surface, except perhaps adjacent the leading edge, of the sheet is not physically contacted by the stripping device 101 or the plate 104.

Figure 3:
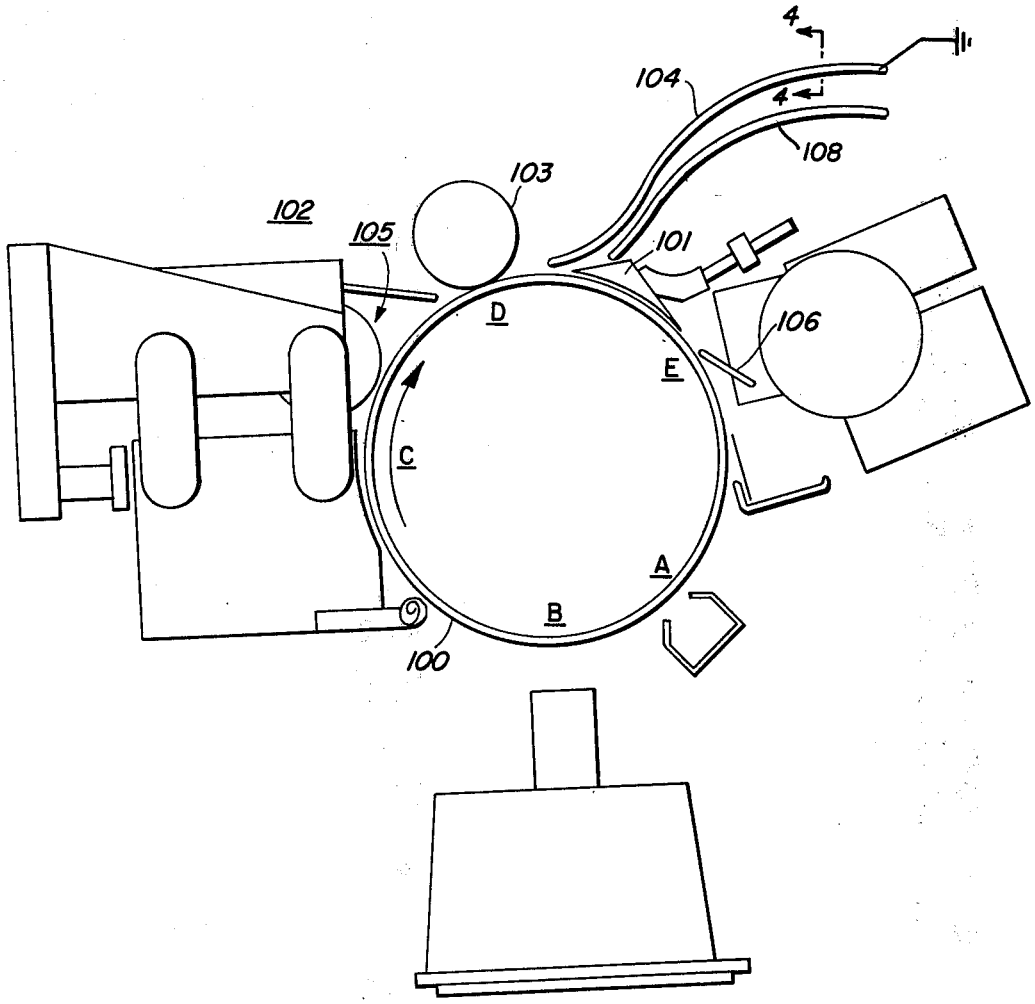
FIG. 3 shows schematically the stripping aid as applied to an electrophotographic machine, which machine uses the same general copying principles as the machine illustrated in FIG. 1.

Referring to FIG. 3, similar parts to FIG. 2 are like numbered. The stages of operation of the copying apparatus are illustrated by lettering as follows on the photoreceptor 100: A is the charging station. B is the exposure station. C is the developing station, in this case comprising a liquid applicator roll 105. D is the transfer station where the image of the original document on the surface of the photoreceptor 100 is transferred to a sheet of paper (not shown). E is the cleaning station comprising a cleaning blade 106.

The stripping aid comprises, as in FIG. 2, a plate 104 which is connected to an earthing point in the apparatus when in use. A second plate 108 beneath the plate 104 extends along the length of plate 104 and is substantially uniformly separated from it. In normal use, the plate 108 takes no active part in the function of the stripping aid. However, if paper passes through the apparatus and the net charge on the surface of the paper is insufficient to generate a strong enough electrostatic field to cause the paper to be attracted against the plate 104, the plate 108 tends to prevent paper jamming in the apparatus. Too small a charge can exist if the apparatus is out-of-operation for some time with a sheet of paper positioned in the transfer station, for example, allowing the surface of the sheet to discharge. Likewise, if the charging station fails to operate then not only will the copying function cease but, the surfaces of the sheets of paper passing through the apparatus will tend to be no longer charged or no longer charged sufficiently.

In carrying out the invention, the guide or plate 104 is maintained at some reference voltage. In the described embodiment the reference voltage is for example and for convenience, zero voltage. Whatever the voltage reference is, an electrostatic field is established due to the charge distributed on the surface of the sheets of transfer medium leaving the transfer station D.

It will be appreciated that this surface charge tends to leak away as soon as the surface of the sheets touches the plate 104. However, in practice and particularly when a liquid development system is used, the leakage is retarded by the inherent high resistance of the oily nature of diluent constituents of the ink. In a dry liquid system, the ink particles tend to be sufficiently electrically resistive to prevent rapid discharge of the surfaces of the sheets so that the electrostatic field exists at least until the functional requirements of the stripping aid is achieved.

In modifications of the embodiments described, the plate 104 is longitudinally grooved or corrugated so that air gaps are formed between the sheets and the plate 104 extending in parallel along the path of travel of the sheets. This tends to reduce the discharge area such that the attracting electrostatic field is maintained for a longer time period than before. For similar reasons, in other modifications, we provide an insulating layer on the plate 104 which covers in one arrangement the plate 104 and in another arrangement covers part of the plate 104. Likewise, this inhibits the leakage of the charge from the surface of the sheets.

The plate 108 is normally formed at least in part, of insulating material or, if electrically conductive, arranged to float in the electrical sense. If this is not the case the surface charges on the sheets of paper may establish an attracting electrostatic field with the plate 108 instead of the plate 104.

In the described embodiment of FIG. 3, the surface of the photoreceptor 100 was charged to about 600 microcoulombs per square meter. The paper sheets used had a dielectric constant in dry air typically equal to $4 \times 8.8 \times 10^{-12}$ farads per meter and a density of 80 grams per square meter. In the embodiment described a sufficiently strong electrostatic field is established if the surface of each sheet leaving the transfer station D has a value of at least 3 microcoulombs per square meter. In practice, we find the surface charge is of the order of about 20 microcoulombs per square meter when copying average office type-written originals. Thus, a satisfactory working margin is generally established in the desired embodiment.

It will be appreciated that, as has been mentioned, if the copying apparatus is suitably positioned, the sheets of paper tend to fall away from the surface of the photoreceptor under the action of gravity. That is, this happens when the stripping station is positioned at the lowest part of the photoreceptor. The stripping aid described may be provided not as described to tend to lift the sheets away from the stripping device, but to pull down the sheets out of contact with the stripping device to assist the gravitational forces acting on the sheet.

Upper and lower most positions of the stripping device have been described and illustrated, and described in the previous paragraph respectively. The stripping aid is also useful in all other positions around the photoreceptor periphery, whenever required for a particular configuration. Thus, although some limitation in the attitude of other stations may exist, say the developing station, depending on what form or type of station is used, liquid or dry and what sort, the stripping aid of the present invention enables stripping to be independent of the point around the surface of the photoreceptor where stripping of the sheet takes place.

A stripping aid according to the invention can be used with virtually all stripping devices. In practice, the forces required to strip the leading edge of sheets cannot be generated by the described earthed planar surface acting alone. However, the stripping aid of this invention can be incorporated as described with most known and proposed stripping devices. The stripping aid can also be used in a non-copying environment, as will be appreciated, provided that the medium to be stripped carries sufficient electrostatic charge on its surface to cooperate with the planar surface to generate an attracting electrostatic field of suitable strength.

While a particular embodiment of the invention has been described above, it will be appreciated that various modifications may be made by one skilled in the art without departing from the scope of the invention as defined in the appended claims.

What is claimed is:

1. The combination of an electrostatographic reproduction machine having means defining a photoconductive surface, means for charging the photoconductive surface, means for exposing the photoconductive surface to form an electrostatic latent image on the surface, means for developing the latent image, and means for transferring the developed image to a transfer sheet, with an improved stripping mechanism, the stripping mechanism comprising means for separating the leading edge of the transfer sheet from the photoconductive surface, a guide disposed adjacent to the separating means for guiding the transfer sheet, means for maintaining the guide at a reference voltage sufficient to set up an electrostatic attraction between the transfer sheet and guide after the leading edge of the transfer sheet has been separated from the photoconductive surface, means for forming a plurality of air gaps between the transfer sheet and the guide during movement of the transfer sheet over the guide, means separated from and extending along and beneath the guide for supporting the transfer sheet in the event the electrostatic attraction is insufficient to attract the transfer sheet to the guide, and means for preventing the transfer sheet from being electrostatically attracted to the supporting means during movement between the guide and the supporting means.

* * * * *